US005096391A

United States Patent [19]

Tuckey

[11] Patent Number: 5,096,391

[45] Date of Patent: Mar. 17, 1992

[54] IN-TANK FUEL RESERVOIR WITH INTEGRAL FILL PUMP

[75] Inventor: Charles H. Tuckey, Cass City, Mich.

[73] Assignee: Walbro Corporation, Cass City, Mich.

[21] Appl. No.: 610,767

[22] Filed: Nov. 8, 1990

[51] Int. Cl.[5] ..... F04B 3/00; F04B 35/04; F04B 23/14

[52] U.S. Cl. ..... 417/423.3; 417/423.5; 417/423.14; 417/244; 417/203

[58] Field of Search ..... 417/423.3, 423.5, 423.14, 417/424.1, 244, 203, 253, 368; 464/57

[56] References Cited

U.S. PATENT DOCUMENTS

| | | | |
|---|---|---|---|
| 2,254,566 | 9/1941 | Cornell | 464/57 |
| 2,514,394 | 7/1950 | Irving | 464/57 |
| 3,443,519 | 5/1969 | White . | |
| 4,865,522 | 9/1989 | Radermacher | 417/203 |
| 4,998,865 | 3/1991 | Nalzanishi et al. | 417/423.14 |

*Primary Examiner*—Richard A. Bertsch
*Assistant Examiner*—Alfred Basichas
*Attorney, Agent, or Firm*—Barnes, Kisselle, Raisch, Choate, Whittemore & Hulbert

[57] ABSTRACT

A fuel delivery system for automotive engine and like applications that includes a canister for positioning within a fuel tank having a lower end with a fuel opening, and an internal wall spaced from such lower end dividing the canister into upper and lower fuel chambers. An electric-motor fuel pump is positioned within the upper chamber, and has a fuel inlet within the upper chamber, a fuel outlet for feeding fuel under pressure to an engine, and a rotary output shaft extending toward the canister wall. An impeller pump is positioned within the lower chamber and is coupled to the output shaft of the electric-motor pump in the upper chamber for pumping fuel from the lower chamber to the upper chamber. The impeller is coupled to the pump output shaft by a flexible coupling in the form of a coil spring. A check valve at the outlet of the impeller pump prevents return flow of fuel from the upper chamber to the lower chamber when the electric-motor pump is de-energized.

2 Claims, 1 Drawing Sheet

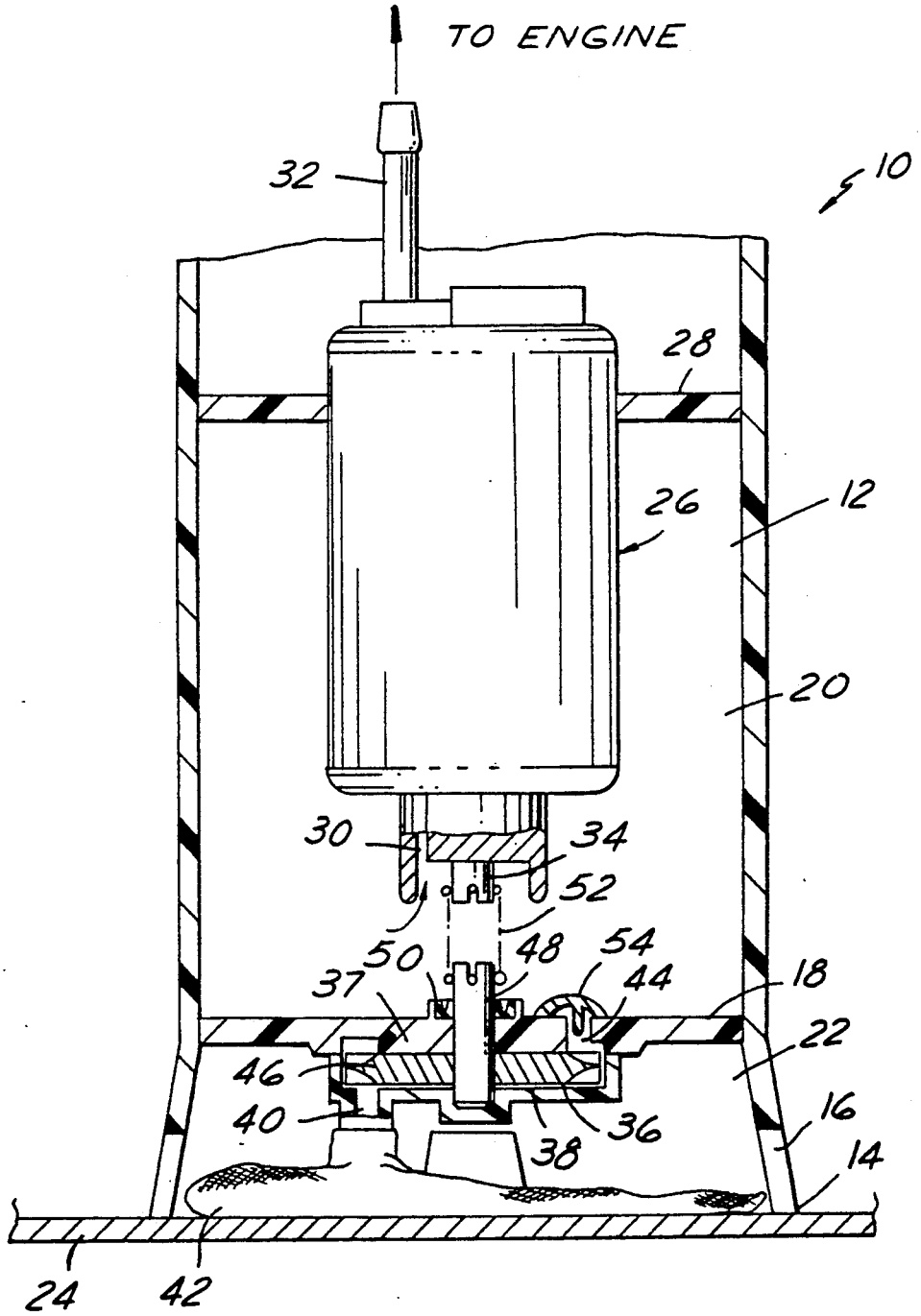
TO ENGINE
32
10
28
26
12
20
30
34
52
50
48
54
37
44
18
22
46
40
36
38
16
14
24
42

IN-TANK FUEL RESERVOIR WITH INTEGRAL FILL PUMP

The present invention is directed to fuel delivery systems for automotive engine and like applications, and more particularly to a fuel pump module that includes an electric-motor fuel pump mounted within an in-tank reservoir.

U.S. Pat. No. 4,878,518, assigned to the assignee hereof, discloses a fuel delivery system for automotive engine and like applications that includes a canister for positioning within a fuel tank. The canister has a lower end with a fuel opening and an internal wall spaced from such lower end dividing the canister into upper and lower fuel chambers. An electric-motor fuel pump is positioned within the upper chamber and has a fuel inlet, a primary fuel outlet at the top of the pump for feeding high-volume fuel under pressure to an engine, and a secondary fuel outlet at the base of the pump for likewise supplying fuel under pressure at smaller volume than the high-volume outlet. A fluid conduit or passages extends through the canister internal wall, and has an inlet end in the lower chamber and an outlet end in the upper chamber. A nozzle couples the secondary pump outlet to the conduit for aspirating fuel through the conduit from the lower chamber to the upper chamber. Thus, any vapor collected in the lower chamber is entrained in aspirated fuel and fed to the upper chamber, where it is free to vent to the fuel tank through the open upper end of the canister.

A general object of the present invention is to provide a fuel delivery system of the described character in which fuel is pumped from the lower chamber to the upper chamber of the canister by a mechanical pump mechanism driven by the electric-motor fuel pump positioned in the upper chamber so as to obtain improved handling in situations where the fuel is hot and/or when fuel level is low in the surrounding tank.

The invention, together with additional objects, features and advantages thereof, will be best understood from the following description, the appended claims and the accompanying drawing, which is a fragmentary sectional view in side elevation of a fuel delivery module in accordance with one presently preferred embodiment of the invention.

The drawing illustrates a fuel delivery system 10 in accordance with one presently preferred embodiment of the invention as comprising a generally cylindrical canister 12 having a lower end 14 with laterally opening fuel passages 16. An internal wall 18 effectively divides canister 12 into an upper chamber 20 having an open upper end, and a lower chamber 22 adjacent to the bottom wall 24 of a fuel tank on which canister 12 rests. An electric-motor fuel pump 26 is centrally and vertically mounted in upper chamber 20 of canister 12 by the radially extending spaced arms or supports 28. Fuel pump 26 has a fuel inlet 30 at its lower end positioned within upper chamber 20 spaced from wall 18, and an outlet 32 at its upper end for delivery of high pressure fuel to the engine (not shown). Pump 26 preferably is of the rotary type disclosed in U.S. Pat. No. 4,596,519, and has a drive shaft 34 that extends through a suitable seal in the lower end of the pump casing axially of the pump and adjacent to fuel inlet 30. The disclosure of U.S. Pat. No. 4,596,519 is incorporated herein by reference for disclosure of internal details of pump 26.

A substantially circular chamber 36 is defined in lower canister chamber 22 by wall 18, which forms an upper wall of chamber 36, and a cup-shaped lower wall 38 that is welded or otherwise permanently affixed about its periphery to the opposing lower surface of canister wall 18. An inlet 40 opens downwardly from chamber 36 to receive fuel from lower canister chamber 22 through a filter sock 42. An outlet 44 extends upwardly through wall 18 for feeding fuel from chamber 36 to upper canister chamber 20. A flat impeller 46 is rotatably captured within chamber 36 between upper wall 37 and lower wall 38. A drive shaft 48 extends into upper chamber 20 through a rotary seal 50 in wall 18, and is coupled to impeller 46 for rotating the impeller about the axis of the impeller and the shaft. Impeller 46 and shaft 48 are positioned in lower chamber 22 on wall 18 so as to be coaxial with output shaft 38 of motor 26 within upper chamber 20. A coil spring 52 has opposed ends that encircle the coaxial shafts 34,48, and has end tines that are received in notches in the respective shafts. Spring 42 thus forms a flexible coupling between shafts 34,48. A check valve 54 is positioned within upper chamber 20 over outlet passage 44 so as to prevent reverse flow of fuel from upper chamber 20 to lower chamber 22 when pump 26 is turned off.

In operation, pump 26 is energized by suitable drive electronics so as to draw fuel from upper canister chamber 20 through inlet 30, and pump fuel under pressure through outlet 32 to the engine. At the same time, output shaft 34 of pump 26 drives impeller 46 through coupling 52 and shaft 48. Impeller 46 draws liquid fuel from lower chamber 22 through inlet 26 and chamber 36, and pumps such fuel through outlet 44 to upper chamber 20. Fuel level in upper chamber 20 is thus maintained at a level sufficient to supply fuel to pump inlet 30 under all operating conditions. In the event that any vapor is entrained in the fuel flowing into lower chamber 22 through passages 16 from the surrounding tank, such vapor is separated from the fuel by the centrifugal action of impeller 26, and is free to rise as bubbles within upper chamber 20 and return to the fuel tank through the open upper end of the canister. In addition, the positive pumping action of impeller 46 helps pull fuel from lower canister chamber 22 even when the level of fuel in the lower chamber and the surrounding tank is relatively low.

The invention claimed is:

1. An automotive engine fuel delivery system that comprises:

a canister for positioning within a fuel tank and having a lower end with an opening, and means forming an internal wall spaced from said lower end and dividing said canister into upper and lower chambers, an electric-motor fuel pump positioned within said upper chamber having a fuel inlet that opens into said upper chamber, a fuel outlet for feeding fuel under pressure to an engine, and a rotary output shaft extending toward said wall, an impeller pump in said lower chamber that includes a circular pump cavity beneath said canister internal wall having an upper cavity wall formed by said canister internal wall and a lower cavity wall spaced from said upper wall, an inlet opening in said lower cavity wall and an outlet opening in said canister wall through which said cavity communicates with said upper chamber immediately above said canister wall, a circular impeller rotatably supported in said pump cavity beneath said canister wall substantially coaxially with said output shaft, an impeller pump drive shaft separate from said output shaft coupled to said impeller and extending through said canister wall into said upper chamber substantially coaxially with said output shaft, and a coil spring having a first end that encircles said output shaft having an end tine received in a notch on said output shaft and a second end that encircles said drive shaft having an end tine received in a notch on said drive shaft in said upper chamber so as to drive rotation of said impeller from said output shaft.

2. The system set forth in claim 1 further comprising a check valve in said upper chamber at said outlet opening from said cavity to prevent flow of fuel from said upper chamber to said lower chamber when said electric-motor pump is turned off.

* * * * *